US006460973B1

(12) United States Patent
Takahashi et al.

(10) Patent No.: US 6,460,973 B1
(45) Date of Patent: Oct. 8, 2002

(54) RECORDING METHOD AND APPARATUS

(75) Inventors: Tomoko Takahashi, Kanagawa; Mitsuo Hasebe, Tokyo, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/550,803

(22) Filed: Apr. 18, 2000

(30) Foreign Application Priority Data

| | | |
|---|---|---|
| Apr. 26, 1999 | (JP) | 11-118796 |
| Jun. 15, 1999 | (JP) | 11-168914 |
| Feb. 8, 2000 | (JP) | 2000-031253 |

(51) Int. Cl.[7] ..... B41J 2/06
(52) U.S. Cl. ..... 347/55
(58) Field of Search ..... 347/103, 101, 347/55, 120, 141, 154, 123, 111, 159, 127, 128, 131, 125, 158; 399/271, 290, 292, 293, 294, 295, 297, 308

(56) References Cited

U.S. PATENT DOCUMENTS 5,841,456 A * 11/1998 Takei et al. ..... 347/103

FOREIGN PATENT DOCUMENTS

| | | |
|---|---|---|
| JP | 5-96720 | 4/1993 |
| JP | 6-92009 | 4/1994 |
| JP | 6-92010 | 4/1994 |
| JP | 7-89067 | 4/1995 |
| JP | 11-188858 | 7/1999 |

* cited by examiner

*Primary Examiner*—Raquel Yvette Gordon
(74) *Attorney, Agent, or Firm*—Oblon, Spivak, McClelland, Maier & Neustadt, P.C.

(57) ABSTRACT

A recording method and apparatus for controlling the condition of a material uniformly and steadily attached to a transfer medium. The recording method comprises the steps of: producing a material that is dissolved or swelled by liquid in advance and increases the viscosity of the liquid on the transfer medium; forming an image on the transfer medium by bringing the liquid into contact with the material; and transferring the image from the transfer medium to a recording medium. The recording method is characterized by the step of producing the material, in which the material is uniformly applied to a surface of the transfer medium.

19 Claims, 6 Drawing Sheets

RECORDING METHOD AND APPARATUS

BACKGROUND OF THE INVENTION

1. Field of the Invention

The present invention relates to an improved recording method and apparatus suitable for forming images by jetting multi-color liquid in accordance with image signals in an ink jet recording system. More particularly, the present invention relates to a method and apparatus for forming a material used to record images repeatedly on a transfer medium in an ink jet recording system utilizing a transfer medium such as an intermediate transfer medium.

2. Description of the Related Art

In a recording method and apparatus, such as an ink jet recording system, that performs recording by jetting multi-color liquid in the form of droplets onto a recording medium in accordance with image signals, it is important to reproduce an image with little bleeding on a recording medium such as plain paper or wood free paper. In view of this, there have been many inventions relating to the recording method and apparatus. Examples of the prior art include the following three types.

1) A method in which an ink is dropped onto a recording medium, and an ink hardening is dropped onto the same spots on the recording medium at the same time as or before/after the ink dropping.

Japanese Laid-Open Patent Application Nos. 6-92009 and 6-92010 each disclose a method in which, when an ink is dropped onto a recording medium, or before/after that, an ink hardening agent is dropped onto the same spots on the recording medium, so that ink bleeding on the recording medium is prevented. However, in accordance with either invention, it is necessary to employ a special dropping unit for the ink hardening agent. Also, the ink hardening time makes the entire recording time longer than normal.

2) A method in which a material for reducing ink bleeding is applied to a recording medium in advance, and the material is fixed onto the recording sheet after the recording.

Japanese Laid-Open Patent Application No. 5-96720 discloses a method in which particles for reducing ink bleeding are applied to plain paper as a recording medium in advance, and the particles are fixed on to the paper after the ink fixing. However, the particles used in this invention dissolve with the ink. As a result, after the fixing, the particles might dissolve with the water or oil that is the solvent of the ink, causing ink bleeding on the recording medium. In view of this, this method is not good enough to maintain stability after the recording.

3) A method in which a transfer medium is employed, and an image is transferred from the transfer medium to a recording sheet after the viscosity of the ink is increased.

Japanese Laid-Open Patent Application No. 7-89067 discloses a so-called transfer-type ink jet recording apparatus. In this recording apparatus, an ink image is temporarily formed on an intermediate transfer medium. After the viscosity of the ink is increased to a desired degree, the image is transferred to a recording medium, so that problems such as ink bleeding can be avoided. However, in accordance with the invention, a surface active agent is applied to the transfer medium so as to improve the wettability. As a result, the ink requires a long time to increase its viscosity, and ink bleeding occurs not only on the transfer medium but also on the recording medium. Because of this, the recording apparatus is unsuitable for high-speed recording. Since the ink bleeding is worse in a solid image, the recording speed of the recording apparatus is limited even if it is applied to a line printer for high-speed recording.

Meanwhile, the applicant has already suggested a recording method and apparatus (Japanese Laid-Open Patent Application No. 9-359208) to solve the problems of the prior art. In accordance with the invention, a material in the form of powder that dissolves and swells with liquid in advance and increases the viscosity of the liquid is applied to a transfer medium, and the liquid is jetted to the transfer medium in accordance with image signals. The image is then transferred from the transfer medium to a recording medium. Thus, with the recording method and apparatus of the invention by the present applicant, high-speed recording can be performed and excellent images can be obtained on a recording medium such as plain paper.

However, there are many types of images, such as characters, pictures, and a mixture of characters and pictures. Since the transfer efficiency and image quality vary with the type of image, it is difficult to obtain a satisfactory image by attaching a single layer of the material that dissolves or swells with liquid and increases the viscosity of the liquid to the transfer medium. In order to overcome this difficulty, more than two layers of the material should be attached to the transfer medium. However, it is extremely difficult to form more than two layers of the material uniformly and securely on the transfer medium. Also, since the image quality depends on the conditions of the layers formed on the transfer medium, it is necessary to control the conditions of the layers.

The recording method and apparatus disclosed in Japanese Laid-Open Patent Application 9-359208 also has a problem with the material attached to the transfer medium in advance. More specifically, the particles in the material can be easily charged due to the contact friction among themselves. As a result, the particles in the material agglomerate, making it difficult to apply the material uniformly to the transfer medium.

SUMMARY OF THE INVENTION

It is a general object of the present invention to provide recording methods and apparatuses in which the above-mentioned problems are eliminated.

A first specific object of the present invention is to provide a recording method and apparatus that easily enable the obtaining of images of various kinds that excel in water resistance and preservability.

A second specific object of the present invention is to provide a recording method and apparatus that enable the obtaining of excellent images by preventing cohesion among particles due to friction charge.

The above objects of the present invention are achieved by a recording method comprising the steps of:

preparing a material that is dissolved or swelled by a liquid in advance and increases the viscosity of the liquid, the material being uniformly formed on a transfer medium;

forming an image on the transfer medium by bringing the liquid into contact with the material; and transferring the image from the transfer medium to a recording medium.

Since the material can be applied uniformly to a surface of the transfer unit, an excellent image can be obtained by the above method.

In the above method of the present invention, no friction is caused in the material prepared. Accordingly, more than two layers of the material can be uniformly and steadily maintained, and the condition of the surface of the material can be adjusted, so that an excellent image can be obtained.

The above objects of the present invention are also achieved by a recording apparatus comprising:

a material preparing unit that prepares a material that is dissolved or swelled by liquid in advance and increases the viscosity of the liquid;

an image forming unit that forms an image on a transfer medium by bringing the liquid into contact with the material; and a transfer unit that transfers the image from the transfer medium to a recording medium, wherein the material preparing unit constitutes a material uniformly-applying unit that uniformly applies the material to the transfer medium.

With the above recording apparatus, the material can be formed uniformly on the transfer medium, so that an excellent image can be obtained.

In this recording apparatus, the material uniformly-applying unit constitutes a contact unit that is brought into contact with the material formed on the transfer medium without causing friction. Accordingly, more than two layers of the material can be uniformly and steadily maintained, and the condition of the surface of the material can be adjusted so as to obtain an excellent image.

Also in the recording apparatus of the present invention, the contact unit has a surface that is smoother than the surface of the material formed on the transfer medium. Accordingly, the layers of the material can be uniform.

In the recording apparatus of the present invention, the surface of the contact unit has regular concavities and convexities. Accordingly, it is possible to prevent removal caused by the materials solidified into layers or cohering due to friction charge. Thus, an excellent image can be obtained.

The recording apparatus of the present invention further comprises a driving unit that moves the surface of the material formed on the transfer medium and the surface of the contact unit at the same speed. Accordingly, no friction is caused in the material on the transfer medium, and the material can be uniformly and steadily fixed to the transfer medium. Thus, an excellent image can be obtained.

In the recording apparatus of the present invention, the contact unit constitutes a rotative unit that rotates in synchronization with the surface of the material formed on the transfer medium. Accordingly, no friction is caused in the material easily formed on the transfer medium, so that an excellent image can be obtained.

Also in the recording apparatus of the present invention, the contact unit further produces a material that is dissolved or swelled by liquid and increases the viscosity of the liquid on the material already formed on the transfer medium. Accordingly, the contact unit serves not only to even and regulate the material already adhering to the transfer medium, but also to apply the material to portions on the surface of the transfer medium not having the material formed thereon.

The above objects of the present invention are also achieved by a recording method comprising the steps of:

preparing a material that is dissolved or swelled by liquid in advance and increases the viscosity of the liquid on a transfer medium, the material being a conductive material;

forming an image on the transfer medium by bringing the liquid into contact with the material; and transferring the image from the transfer medium to a recording medium.

Since the material is a conductive material in this method, a decrease in fluidity due to cohesion among the particles in the material caused by friction charge can be prevented. Accordingly, the material can be uniformly applied onto the surface of the transfer medium, and an excellent image can be repeatedly obtained.

In the above recording method of the present invention, the conductive material is a sodium salt of poly(acrylic acid), a salt of poly(acrylic acid) and aliphatic amine, or the salts containing a conductive powder at a given weight ratio. Accordingly, a decrease in fluidity due to cohesion among the particles in the material caused by friction charge can be prevented. Thus, the material can be applied uniformly to the transfer medium, and an excellent image can be repeatedly obtained.

Also in the recording method of the present invention, the step of preparing the material includes the steps of: holding the conductive material; and creating an electric potential difference between the conductive material and the transfer medium when the conductive material is transferred to the transfer medium. Accordingly, the material made up of conductive particles can be easily and uniformly applied to the surface of the transfer medium.

In the recording method of the present invention, the step of holding the conductive material includes a step of injecting an electric charge into the conductive material. Accordingly, the charged material made up of conductive particles can be easily and uniformly applied to the surface of the transfer medium.

Also in the recording method of the present invention, the step of creating the potential difference includes the step of electrifying the transfer medium. Accordingly, the material made up of conductive particles can be easily and uniformly applied to the surface of the transfer medium.

The above objects of the present invention are also achieved by a recording apparatus comprising:

a material preparing unit that prepares a material that is dissolved or swelled by liquid in advance and increases the viscosity of the liquid on a transfer medium, the material being a conductive material;

an image forming unit that forms an image on the transfer medium by bringing the liquid into contact with the material;

a transfer unit that transfers the image from the transfer medium to a recording medium;

a conductive material holding unit that holds the conductive material;

an electrode unit that sandwiches the transfer medium with the conductive material holding unit, and is situated opposite to the surface to which the material is transferred; and a potential difference creating unit that creates a potential difference between the conductive material holding unit and the electrode unit.

With the above recording apparatus of the present invention, the material made up of conductive particles can be easily and uniformly applied to the surface of the transfer medium.

In the recording apparatus of the present invention, the conductive material holding unit is constituted by an elastic member. Accordingly, the contact area between the conductive material holding unit and the transfer medium becomes larger, so that the conductive particles can be uniformly and steadily applied to the surface of the transfer medium.

In the recording apparatus of the present invention, the elastic member is a urethane rubber roller, a silicone rubber roller, or a silicone sponge roller. Accordingly, the conductive particles can be more uniformly and steadily applied to the surface of the transfer medium.

The above objects of the present invention are also achieved by a recording apparatus comprising:

- a material preparing unit that prepares a material that is dissolved or swelled by liquid in advance and increases the viscosity of the liquid in a transfer medium, the material being a conductive material;
- an image forming unit that forms an image on the transfer medium by bringing the liquid into contact with the material;
- a transfer unit that transfers the image from the transfer medium to a recording medium;
- a conductive material holding unit that holds the conductive material;
- a first charging unit that charges the conductive material holding unit;
- a second charging unit that charges a surface of the transfer medium; and
- a material affixing unit that affixes the conductive material to the surface of the transfer medium by means of an electric charge injected into the conductive material by the conductive material holding unit.

With this recording apparatus of the present invention, the conductive particles can be easily and uniformly applied to the surface of the transfer medium.

In the recording apparatus of the present invention, the material affixing unit also serves as a transfer unit that transfers the conductive material. Accordingly, the conductive particles can be more easily and uniformly applied to the surface of the transfer medium.

Other objects and further features of the present invention will become more apparent from the following description taken in conjunction with the accompanying drawings.

DESCRIPTION OF THE PREFERRED EMBODIMENTS

The following is a description of embodiments of the present invention, with reference to the accompanying drawings.

Figure 1:
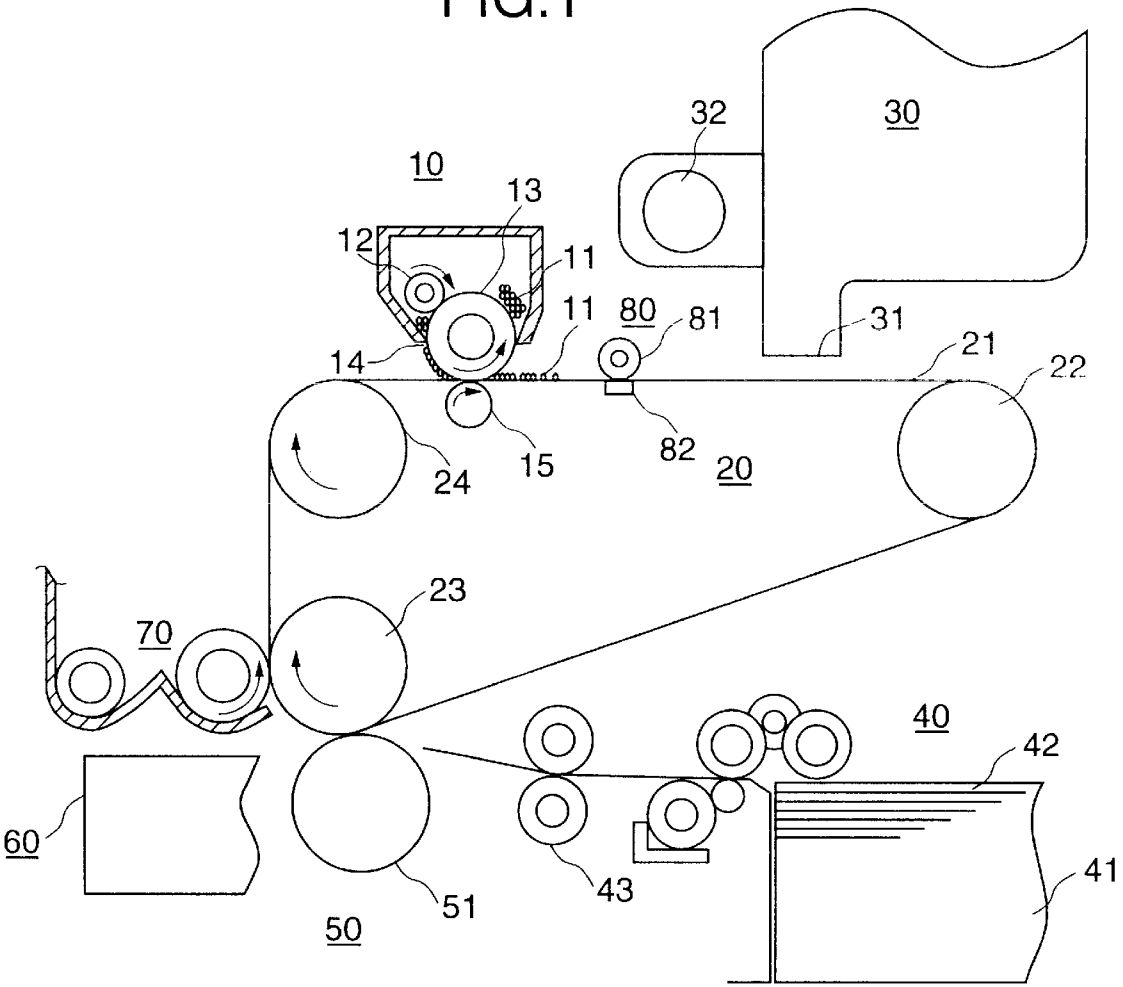
FIG. 1 illustrates a first embodiment of a recording method and apparatus in accordance with the present invention.

FIG. 1 illustrates a first embodiment of a recording method and a recording apparatus of the present invention. This embodiment comprises a setting agent applying unit 10, an intermediate transfer unit 20, a printing unit 30, a sheet feeding unit 40, a transfer unit 50, a sheet discharging unit 60, a setting agent removing unit 70, and a contact unit 80. The setting agent applying unit 10 uniformly applies a material (setting agent) onto the transfer unit 20.

The recording apparatus having the above structure operates as follows. First, upon receipt of a printing start signal, the setting agent applying unit 10 uniformly applies a setting agent 11 onto the surface of an intermediate transfer belt 21 of the intermediate transfer unit 20. The setting agent 11 is a powdery agent having good water absorption capacity and a particle diameter of 0.1 to 30 $\mu$m, such as acrylic acid resin, copolymer resin including acrylic acid and methacrylic acid, methacrylic acid resin, or starch. Along with the operation of the setting agent applying unit 10, the intermediate transfer unit 20 operates, so that the setting agent 11 is applied onto the intermediate transfer belt 21 at the contact point between the setting agent applying unit 10 and the intermediate transfer unit 20. This process will be described later in detail.

The surface layer, to which the setting agent 11 is applied, of the intermediate transfer belt 21 is made of an elastic material such as silicone rubber, fluoro-rubber, or epichlorohydrine rubber. The elastic material can be disposed on the surface of a resin belt made of PET (polyethylene terephthalate) or polyimide, or on the surface of a metallic belt made of aluminum nickel or the like. The elastic material can also be formed on a metallic drum. The intermediate transfer unit 20 comprises three rollers 22, 23, and 24, and the intermediate transfer belt 21, a drive motor (not shown), a position control encoder (not shown), and a box-like housing. The rotation of the drive motor is transmitted to the rollers 22, 23, and 24, so that the intermediate transfer belt 21 is cycled in the direction indicated by arrows in FIG. 1.

As the intermediate transfer belt 21 cycles, the setting agent 11 applied onto the intermediate transfer belt 21 moves to the contact unit 80. The contact unit 80 comprises a contact roller 81 and a counter member 82 that sandwiches the intermediate transfer belt 21 with the contact roller 81. The contact roller 81 presses the setting agent 11 so as to equalize the setting agent 11 on the intermediate transfer belt 21. The novel features of the present invention reside in the contact unit 80, which will be described later in greater detail.

When the setting agent 11 on the intermediate transfer belt 21 reaches the printing unit 30, a printing operation is started, and the printing unit records image information of an image or text on the setting agent 11 on the intermediate transfer belt 21. In this embodiment, the printing unit 30 employs a shuttle scanning system in which an ink jet head 31 slides along a rod member 32. However, it is also possible to employ a line head system. If a line head constitutes the printing unit, high-speed and continuous recording and transferring can be carried out.

Each recording sheet 42 is sent from a sheet feeding cassette 41 of the sheet feeding unit 40 to a resist roller 43. The recording sheet 42 is then sent from the resist roller 43 to the transfer unit 50. A transfer roller 51 of the transfer unit 50 presses the recording sheet 42 to transfer the image information on the intermediate transfer belt 21 to the recording sheet 42. After that, the discharge unit 60 discharges or stores the recording sheet 42. On the part of intermediate transfer belt 21 that has passed through the transfer unit 50, some portions of the setting agent 11 which has not been used for recording normally remains without being removed. In the next recording operation, the setting agent applying unit 10 replenishes the intermediate transfer belt 21 for the used portions of the setting agent 11. However, if the next recording operation is not to be performed until a long period of time passes, the unused portions of the setting agent 11 are raked out by the setting agent removing unit 70, because the unused portions might have absorbed moisture.

The setting agent applying unit 10 comprises a supply brush 12, an application roller 13, and a doctor 14. The amount of the setting agent 11 on the application roller 13 is determined by the amount of setting agent 11 supplied from the supply brush 12 and the contact pressure applied to the application roller 13 by the doctor 14. A necessary amount of setting agent 11 is held on the application roller 13 and is then supplied to the surface of the intermediate transfer belt 21. A counter member 15 is disposed on the side of the intermediate transfer belt 21 opposite to the application roller 13. Although a stainless steel roller is used as the counter member 15 in this embodiment, the counter member 15 can take any other shape, such as plate-like shape, as long as it provides enough pressure to maintain the contact between the application roller 13 and the intermediate transfer belt 21.

Figure 2:
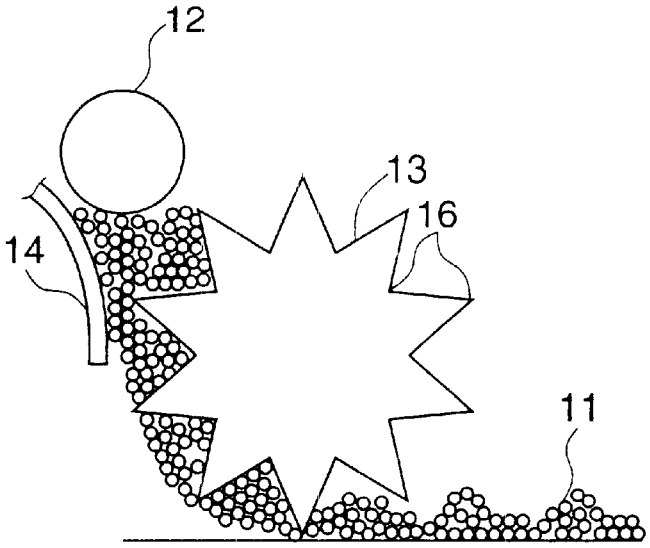
FIG. 2 illustrates a first example of a setting agent applying unit of the recording apparatus in accordance with the present invention.

FIG. 2 illustrates how the setting agent 11 is applied to the intermediate transfer belt 21 from the application roller 13. The surface 16 of the application roller 13 has concavities and convexities, so that the setting agent 11 supplied from the supply brush 12 enters the concavities by means of the doctor 14. When the outermost part of the setting agent 11 in the concavities is brought into contact with the intermediate transfer belt 21, the entire setting agent 11 in the concavities moves onto the intermediate transfer belt 21 at once. This is because the particles of the setting agent 11 in the concavities stick to one another by their own small adhesive force, and the adhesive force of the surface of the intermediate transfer belt 21 attracts the setting agent 11.

Figure 3A:
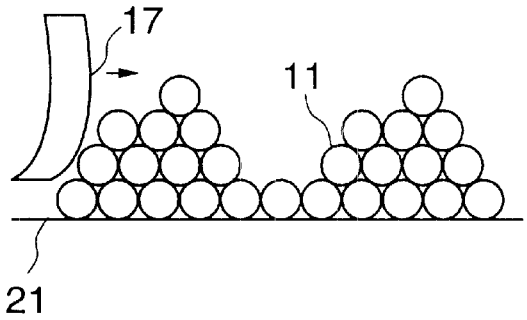
FIGS. 3A and 3B illustrate a case where a blade is brought into contact with setting agent adhering to an intermediate transfer belt in the recording apparatus.
Figure 3B:
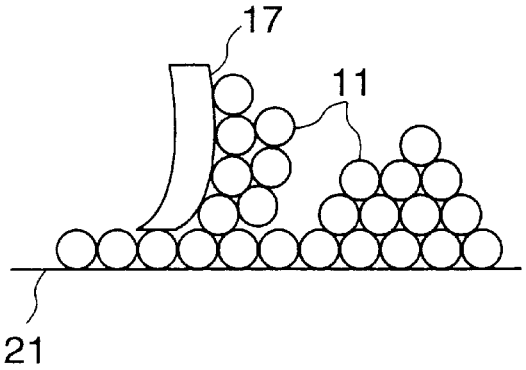

FIG. 3A shows a case where a blade 17 is brought into contact with the setting agent 11 adhering to the intermediate transfer belt 21, and is moved in the direction of the arrow in the figure. As the blade 17 is brought into contact with the setting agent 11, it scrapes against the setting agent 11, as shown in FIG. 3B. As a result, the setting agent 11 is dispersed, except for a thin layer of the particles left on the surface of the intermediate transfer belt 21. This is because the adhesive force among the particles of the setting agent 11 is small, and the adhesive force between the intermediate transfer belt 21 and the setting agent 11 is larger. In order to consistently maintain more than two layers of the particles of the setting agent 11 adhering to the intermediate transfer belt 21, it is necessary to avoid causing friction with the setting agent 11. Also, once the setting agent 11 is transferred onto the intermediate transfer belt 21, it is desirable to avoid having anything brought into contact with the setting agent 11.

The concavities and convexities on the application roller 13 may be either regular or irregular. The concavities and convexities can be formed by sandblasting the surface of an elastic material, such as silicone rubber, EPDM (ethylene propylene rubber), or urethane, or a rigid material, such as metal or polycarbonate resin. Foamed rubber or urethane may also be employed. Although the setting agent applying unit 10 is defined as rollers in the above description, it can take any other suitable form, such as a belt. If the application roller 13 is made of a rigid material, it can be easily manufactured at lower cost. If the application roller 13 is made of an elastic material, the contact area with the intermediate transfer belt 21 will be wider, and the pressure can be uniformly applied. The application roller 13 made of an elastic material also reduces noise.

Other than the technique of applying the setting agent 11 to the surface of the intermediate transfer belt 21 by means of the concavities and convexities of the application roller 13, a technique utilizing an electric field to apply the setting agent 11 may be employed. In this case, it is necessary to use an electrode to electrically charge the setting agent 11. This modification will be described later in greater detail.

The contact unit 80, which characterizes the present invention, comprises the contact roller 81 that is in contact with the setting agent 11 on the intermediate transfer belt 21, and the counter member 82. The contact roller 81 is brought into contact with the setting agent layer on the intermediate transfer belt 21 so as to press down the setting agent layer. The surface roughness of the setting agent layer on the intermediate transfer belt 21 reflects the surface roughness of the contact roller 81 after contact. The surface of the contact roller 81 is manufactured smoother than the surface of the setting agent layer on the intermediate transfer belt 21, so that the setting agent layer is evened by the contact to obtain a smoother surface. If the contact roller 81 having regular concavities and convexities on its surface is brought into contact with the setting agent layer, the surface of the setting agent layer on the intermediate transfer belt 21 will have regular concavities and convexities. Since the setting agent 11 on the intermediate transfer belt 21 is made up of particles as described before, strong cohesion among the particles means poor flexibility of the setting agent layer, and the setting agent 11 easily flakes off the intermediate transfer belt 21 when it reaches a point where the rotation curvature is large. On the other hand, if the setting agent layer comprises a thin particle layer having regular concavities and convexities, the setting agent 11 will not easily come off. Also, regular concavities and convexities reduce noise.

Although the contact unit 80 of the embodiment shown in FIG. 1 does not have a function to apply the setting agent 11 to the intermediate transfer belt 21, it is possible to employ a contact unit having a function to apply the setting agent 11. The contact unit having a function to apply the setting agent 11 can not only even and regulate the setting agent 11 already adhering to the intermediate transfer belt 21, but also apply the setting agent 11 to areas not having the setting agent 11. Thus, a more even setting agent layer can be obtained.

In order to avoid the problem shown in FIGS. 3A and 3B, it is necessary not to cause friction with the setting agent 11. In view of this, the surface of the contact roller 81 needs to move at the same speed as the surface of the intermediate transfer belt 21. Alternatively, the contact roller 81 should move with the intermediate transfer belt 21. By doing so, no friction is caused in the setting agent 11. Therefore, a preferred embodiment of the contact unit 80 is a rotative unit that is moved by a motor, a follower support axis, or any other suitable movement unit.

In order to eliminate the above drawbacks and to constantly obtain more than two layers of the particles of the setting agent in the setting agent layer, the inventors carried out a test on the setting agent applying conditions.

An aqueous ink jet printer was used as a recording apparatus that utilizes ink droplets, and TYPE 6200 (manufactured by Richo Company, Ltd.) was used as recording sheets. Poly(acrylic acid) resin having a mean diameter of 0.5 $\mu$m was used as the setting agent 11. An acrylic brush was used as the supply brush 12, and silicone sponge having a foam diameter of about 100 $\mu$m, a rubber thickness of 3 mm, and a rubber hardness of A40 degrees (by the Japanese Industrial Standards) was used as the application roller 13. A silicone belt was used as the intermediate transfer belt 21. The contact unit 80 was composed of urethane rubber coated with Teflon, and the contact roller 81 had a surface roughness of 7 $\mu$m and a diameter of 20 mm. The number of revolutions of the contact roller 81 was 58 rpm, and the linear velocity of the intermediate transfer belt 21 was 60 mm/s.

Under the above conditions, the application roller 13 in contact with the intermediate transfer belt 21 was rotated, so that the setting agent 11 on the application roller 13 moved to the intermediate transfer belt 21. Here, the amount of the setting agent 11 adhering to the intermediate transfer belt 21 was measured and determined to be about 100 $\mu$g/cm$^2$. Also, the setting agent 11 adhering to the intermediate transfer belt 21 was made up of a number of layers. The contact unit 80 was then brought into contact with the setting agent 11 adhering to the intermediate transfer belt 21, and recording with droplets and transferring to recording sheets 42 were performed. As a result, excellent images were obtained without setting agent remnants on the intermediate transfer belt 21 after the transfer. It was also found that the obtained images excelled in reproducibility of the minute lines in character images, and in smoothness of photographic half-tone images.

Next, recording with droplets without bringing the contact unit 80 into contact with the setting agent 11 on the intermediate transfer belt 21 was performed immediately after the application of the setting agent 11 to the intermediate transfer belt 21. As a result, the obtained images were poorer in quality than the images obtained by the recording with the contact unit 80 being brought into contact with the setting agent 11 on the intermediate transfer belt 21. For instance, the minute lines in character images were broken, or the half-tone portions were rough. When the number of revolutions of the contact roller 81 was doubled, the setting agent 11 started coming off the intermediate transfer belt 21. When the number of revolutions of the contact roller was halved, a part of the setting agent got stuck at the inlet side of the contact unit 80. In either case, a good primary-color image with no bleeding was obtained. However, there was bleeding in secondary color and tertiary color. This may be because the amount of setting agent 11 adhering to the intermediate transfer belt 21 had decreased.

On the other hand, it was found that, when the linear velocity of the contact roller 81 corresponded to the linear speed of the intermediate transfer belt 21, the setting agent 11 was prevented from coming off the intermediate transfer belt 21, and an excellent image was obtained.

Figure 4:
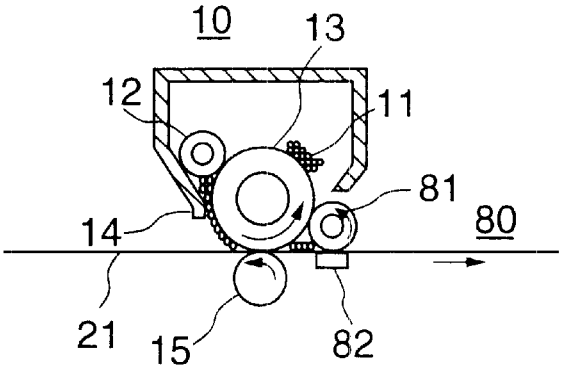
FIG. 4 illustrates a second example of the setting agent applying unit of the recording apparatus in accordance with the present invention.

Next, the conditions of the application of the setting agent 11 were determined using a device shown in FIG. 4. This figure shows the setting agent 11, the supply brush 12, the application roller 13, the blade 14, and the counter member 15. The contact unit 80 comprises contact roller 81 and the counter member 82. The application roller 13 and the contact roller 81 are both in contact with the intermediate transfer belt 21, and rotate together. The application roller 13 and the contact roller 81 in FIG. 4 are both made of urethane sponge. In the device shown in FIG. 4, the setting agent 11 is also applied to the surface of the contact roller 81. The contact unit 80 is brought into contact with the setting agent 11 adhering to the intermediate transfer belt 21, so as to increase the amount of setting agent 11 adhering to the intermediate transfer belt 21.

The inventors carried out a test to determine the conditions of application of the setting agent 11, using the device shown in FIG. 4. An aqueous ink jet printer was used as a recording apparatus that performs recording with ink droplets, and TYPE6200 (manufactured by Richo Company, LTD.) was used as recording sheets. Poly(acrylic acid) resin having a mean diameter of 2 to 3 $\mu$m was used as the setting agent 11. An acrylic brush was used as the supply brush 12, and urethane sponge having a cell diameter of about 200 $\mu$m was used as the application roller 13. A silicone belt was used as the intermediate transfer belt 21. The contact unit 80 was composed of urethane sponge having a cell diameter of about 200 $\mu$m.

In order to see the difference between a case where the contact unit 80 was employed and a case where the contact unit 80 was not employed, an image formed by droplets was first outputted onto the setting agent layer. Where the contact unit 80 was not employed, the minute lines in characters were broken, and bleeding was found in solid portions of the image. Where the contact unit 80 was employed, the bleeding did not occur, and the minute lines in the characters were not broken. Where the application roller 13 had relatively coarse concavities and convexities, the contact unit 80 applied the setting agent 11, so that the setting unit was more uniformly applied to the intermediate transfer belt 21. Where the contact unit 80 was not employed, the amount of the setting agent 11 adhering to the intermediate transfer belt 21 was about 100 $\mu$g/cm$^2$. Where the contact unit 80 was employed, on the other hand, the amount of the setting agent 11 adhering to the intermediate transfer belt 21 was about 120 $\mu$g/cm$^2$.

Figure 5:
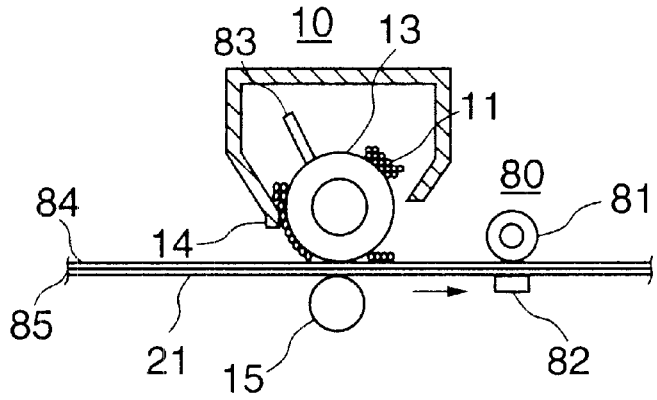
FIG. 5 illustrates a third example of the setting agent applying unit of the recording apparatus in accordance with the present invention.

Next, the conditions of application of the setting agent 11 were determined using a device shown in FIG. 5. In this embodiment, the intermediate transfer belt 21 had a two-layered structure that comprised a sheet-like conductive substrate 85 and a dielectric layer 84 having a thickness of about 50 $\mu$m formed on the conductive substrate 85. The application roller 13 was made of silicone rubber with dispersed carbon having an electric resistance of $10^2$ $\Omega$cm. The setting agent applying unit 10 of this embodiment has a setting agent charging blade 83 made of urethane. A voltage was applied between the application roller 13 and the conductive substrate 85 of the intermediate transfer belt 21. Poly(acrylic acid) resin having a mean diameter of 1 $\mu$m was used as the setting agent 11. An SUS roller having a knurled surface at a pitch of 60 or 100 $\mu$m was used as the contact roller 81. In this device, the blade 83 was brought into contact with the setting agent 11, thereby electrically charging the setting agent 11. The charged setting agent 11 then adhered to the intermediate transfer belt 21 by virtue of the electric field. As the intermediate transfer belt 21 moved, the setting agent 11 adhering to the intermediate transfer belt 11 was brought into contact with the contact roller 81 that rotated with the intermediate transfer belt 21. The inventors carried out a test using the two contact rollers having different pitches (60 $\mu$m and 100 $\mu$m). As a result, the setting agent 11 adhering to the intermediate transfer belt 21 had concavities and convexities corresponding to the surface roughness of the contact roller that had been in contact with the setting agent 11. The setting agent 11 did not come off the intermediate transfer belt 21 even at the larger curvature portions. Thus, it was found that an excellent image could be obtained with the device.

Figure 6:
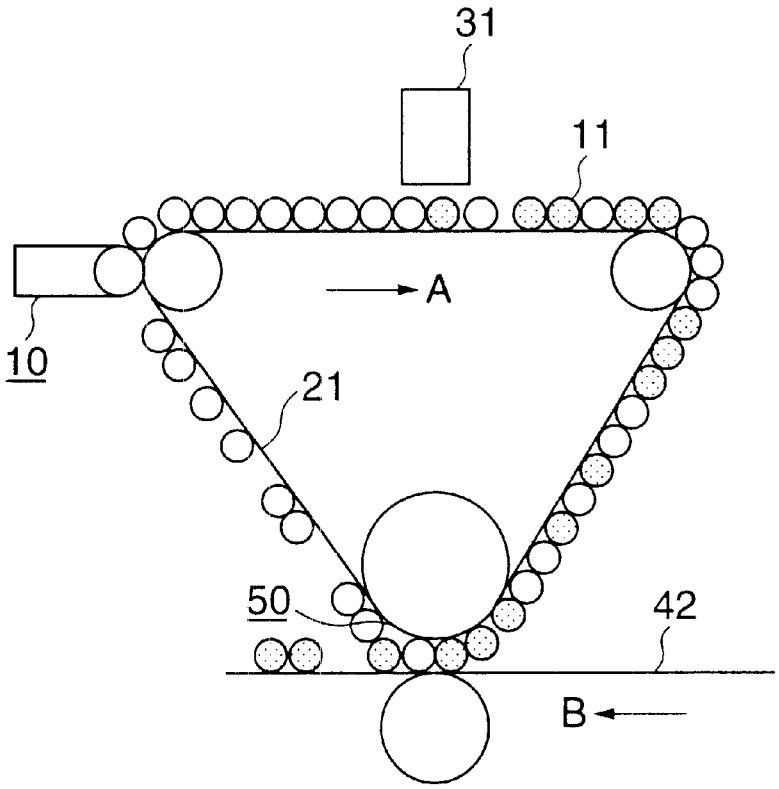
FIG. 6 illustrates a second embodiment of the recording method and apparatus in accordance with the present invention.

FIG. 6 illustrates a second embodiment of the recording method and apparatus in accordance with the present invention. In FIG. 6, the same components as in FIG. 1 are denoted by the same reference numerals. FIG. 6 shows the intermediate transfer belt 21, the ink jet head 31, the setting agent 11 that, when brought into contact with ink, increases the ink's viscosity, the transfer unit 50, the recording sheet 42 as a recording medium, and the setting agent applying unit 10. The intermediate transfer belt 21 moves in the direction of an arrow A. The setting agent 11 adhering to the intermediate transfer belt 21 when brought into contact with liquid ink jetted by the ink jet head 31 increases the liquid ink's viscosity. By doing so, an image having an increased viscosity is formed on the intermediate transfer belt 21. The image formed on the intermediate transfer belt 21 is then transferred onto the recording sheet 42 moving in the direction of an arrow B. After the recording sheet 42 passes through the transfer unit 50, the entire image is transferred, and only some portions of the setting agent 11 not used in thickening the ink remain on the intermediate transfer belt 21. The intermediate transfer belt 21 moves further so that the setting agent applying unit 10 replenishes the intermediate transfer belt 21 with the setting agent 11.

The ink jet head 31 jets aqueous ink onto the setting agent 11 so as to form an image. The setting agent 11 serves to increase the viscosity of the aqueous ink. The setting agent 11 is made up of a water-absorbing powder, such as acrylic acid resin, copolymer resin including acrylic acid and methacrylic acid, methacrylic acid resin, cellulose resin, polyvinyl pyrrolidone, or starch. In order to apply the water absorbing setting agent 11 uniformly onto the intermediate transfer belt 21, the setting agent 11 should have certain fluidity.

The intermediate transfer belt 21 comprises a nickel belt and a silicone rubber layer formed on the nickel belt. However, any other material can be used as the surface layer of the intermediate transfer belt 21, as long as it has separability with the setting agent 11. Example materials for the surface layer of the intermediate transfer belt 21 include silicone rubber, fluorine-containing rubber, silicone resin, fluorine-containing resin, and polyimide resin. Although the intermediate transfer belt 21 is in the form of a belt in FIG. 6, it can take another form such as a drum. It is also possible to form the substrate of the intermediate transfer belt 21 by a conductive resin or metal, with the surface layer being formed by a material having separability with the setting agent 11. Even a non-conductive substrate can be employed, as long as the surface layer has separability with the setting agent 11. In that case, an electrode (not shown) should be disposed in a position opposite to the setting agent applying unit 10.

In the intermediate transfer-type recording method and apparatus, the setting agent 11 needs to have a high fluidity so that it can be applied uniformly onto the intermediate transfer belt 21. By giving conductivity to the setting agent 11 in the present invention, cohesion among the particles in the setting agent 11 due to electric charge can be prevented, and the uniformity of the application of the setting agent 11 can be improved. When two insulating materials are brought into contact with each other, contact charging normally occurs in each contact surface. One of the contact surfaces is positively charged while the other contact surface is negatively charged. Since the two materials are insulators, they maintain the electric charges. The negatively charged surface and the positively charged surface attract each other by Coulomb force, and adhere to each other. In view of this, an insulating setting agent is unsuitable for the recording apparatus of this invention, because of its poor fluidity. Where the setting agent 11 is conductive, on the other hand, the contact charging among the particles of the setting agent can be instantly neutralized, thereby preventing cohesion among the particles of the setting agent. Since the conductive setting agent 11 of the present invention maintains high fluidity, it can be easily applied uniformly to the surface of the intermediate transfer belt 21.

Figure 7:
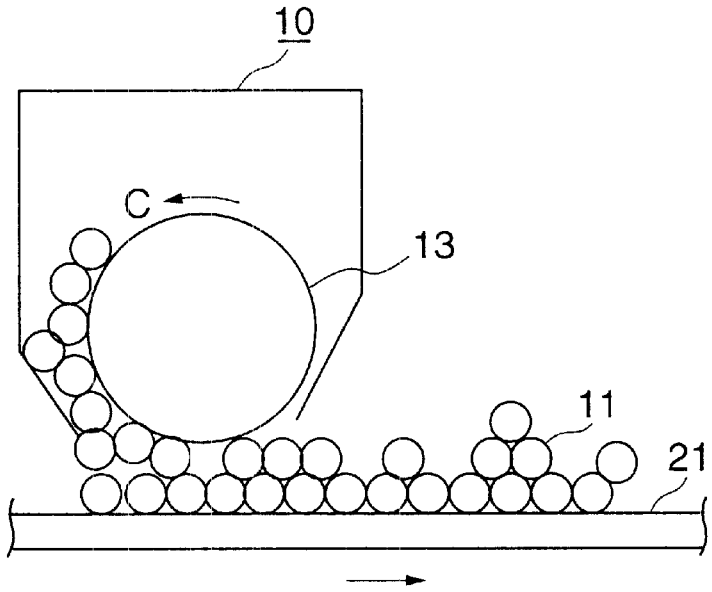
FIG. 7 shows a setting agent applying unit used in an experiment to determine the effects of a conductive setting agent.

The inventors carried out an experiment to evaluate the effects of the conductive setting agent 11. The experiment was carried out using the setting agent applying unit 10 that applied the setting agent 11 to the intermediate transfer belt 21 with the application roller 13 rotating in the direction of an arrow C shown in FIG. 7. In FIG. 7, the same components as in FIG. 6 are indicated by the same reference numerals.

First, to examine the conductivity of the setting agent 11, a setting agent layer having a thickness of 1 mm was formed on a grounded electrode. The setting agent layer was then charged, and its surface potential was measured. The surface potential immediately after the charging was about 2000 V. If the surface potential did not attenuate in 1 minute, the setting agent layer was determined to be an insulator. If the surface potential attenuated to substantially 0 V in 1 minute, the setting agent layer was determined to be conductive.

To indicate the fluidity, the cohesion rate was measured using Powder Test (Trade Name: manufactured by Hosokawa Micron Inc.). The numbers of meshes used to measure the cohesion were 150, 75, and 45. The intermediate transfer belt 21 used in this experiment was made of silicone rubber. The results of the experiment are shown in Table 1.

TABLE 1

| Type of Setting Agent | Conductivity | Cohesion | Application Condition |
|---|---|---|---|
| Setting Agent A | X | 80% | The applied layer was coarse and uneven |
| Setting Agent B | ○ | 35% | The applied layer was smooth and relatively even |
| Setting Agent C | ○ | 10% | The applied layer was smooth and relatively even |

As can be seen from the Table 1, preferable transfer images with little unevenness were formed with the use of the conductive setting agents B and C. In the case of the non-conductive setting agent A, the obtained transfer image had broken minute lines and uneven solid portions. This was because a part of the setting agent 11 that had not satisfied the transfer conditions remained on the intermediate transfer belt 21 due to the unevenness in the application of the setting agent 11.

Examples of the conductive setting agents used in this experiment include a sodium salt of poly(acrylic acid), a salt of poly(acrylic acid) and aliphatic amine, and the salts containing a conductive powder at a given weight ratio. Examples of the insulating setting agent used in this experiment include poly(acrylic acid), cellulose, and polyvinyl pyrrolidone. As a result, it became apparent that a conductive setting agent is much more suitable than an insulating setting agent for intermediate transfer-type image formation.

Figure 8:
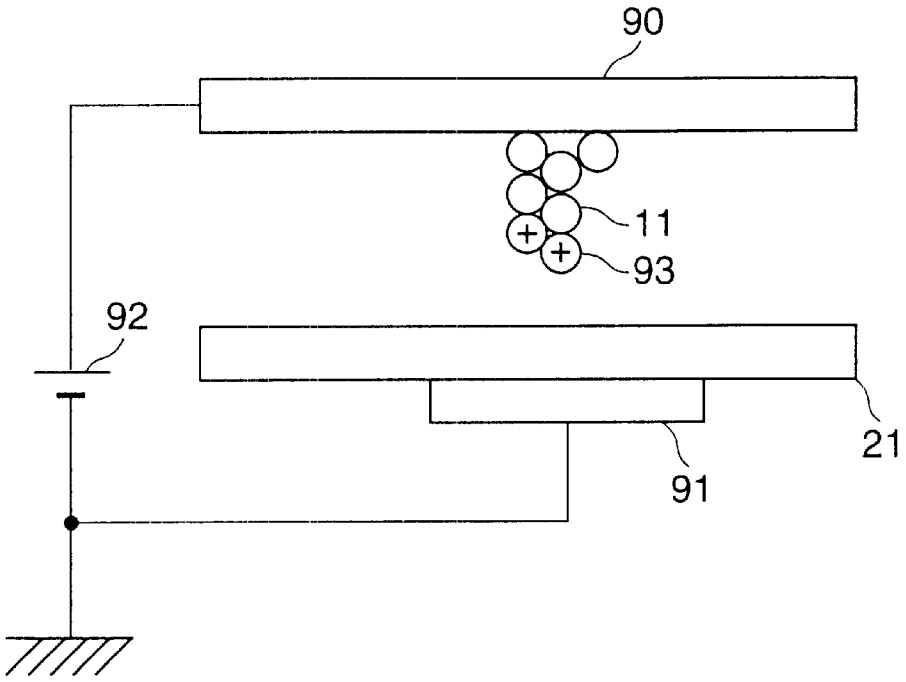
FIG. 8 illustrates a first principle of preferred application of a conductive setting agent onto the intermediate transfer belt.

FIG. 8 illustrates a first principle of preferred application of the conductive setting agent 11 onto the intermediate transfer belt 21. In FIG. 8, the conductive setting agent 11 is held by a conductive setting agent holding unit 90. The intermediate transfer belt 21 is an insulator, and the conductive setting agent 11 is applied to the surface of the intermediate transfer belt 21 facing the conductive setting agent 11. Reference numeral 91 indicates an electrode. A power source 92 is interposed between the conductive setting agent holding unit 90 and the electrode 91 so as to create a potential difference. In FIG. 8, the potential of the conductive setting agent holding unit 90 is higher. With the conductive setting agent 11 being held by the conductive setting holding unit 90, an electric charge is induced in the conductive setting agent on the side of the electrode 91. The charged conductive setting agent 11 is drawn toward the electrode 91, and so adheres to the intermediate transfer belt 21. The electrode 91 on the opposite side of the intermediate transfer belt 21 from the conductive setting agent 11 maintains a reverse charge to the conductive setting agent 11, as if it were fully charged with the intermediate transfer belt 21 serving as a capacitor. Accordingly, if the current supply from the power source 92 is cut off, the conductive setting agent 11 will securely adhere to the intermediate transfer belt 21. In this manner, the conductive setting agent 11 can be easily and steadily transferred and attached to the intermediate transfer belt 21.

Figure 9:
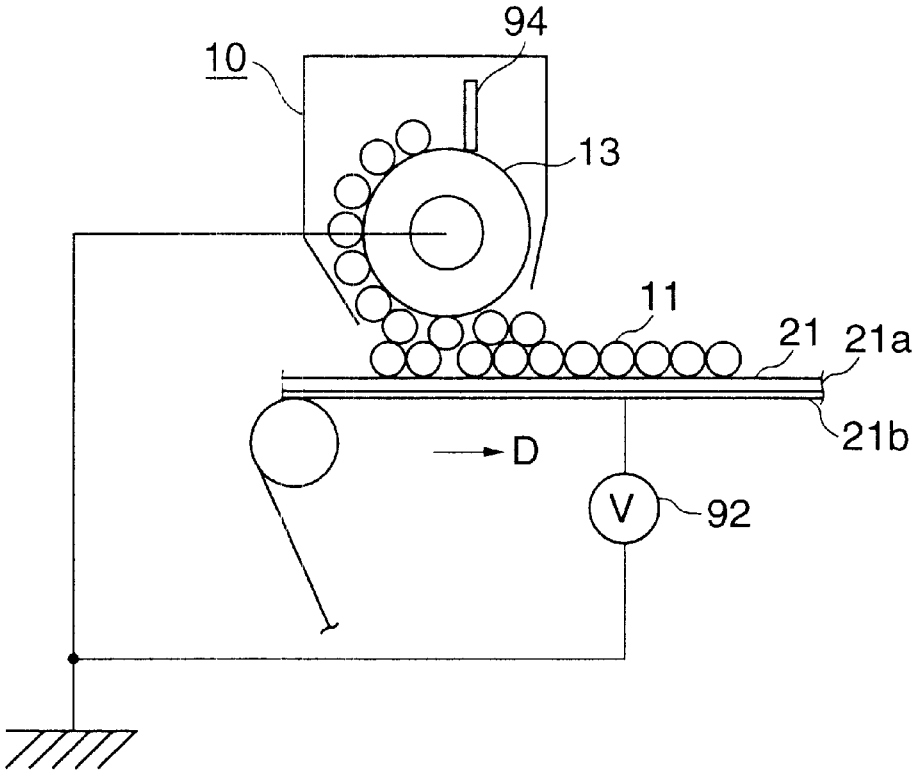
FIG. 9 shows an embodiment to which the first principle shown in FIG. 8 is applied.

FIG. 9 shows an embodiment to which the first principle shown in FIG. 8 is applied. This embodiment comprises the intermediate transfer belt 21, the application roller 13, a blade 94 that restricts a conductive setting agent layer formed on the application roller 13, the power source 92, and the conductive setting agent 11. When seen in an enlarged view, the intermediate transfer belt 21 comprises a conductive polyimide substrate 21*b* and a silicone rubber layer 21*a* formed on the conductive polyimide substrate 21*b*. The silicone rubber layer 21*a* is brought into contact with the application roller 13. The resistivity of the silicone rubber layer 21*a* is $10^{12}$ Ωcm or higher, while the resistivity of the conductive polyimide substrate 21*b* is $10^{3}$ Ωcm or lower. The application roller 13 comprises a stainless steel roller and a urethane layer formed around the stainless steel roller. The resistivity of the urethane layer is $10^{8}$ Ωcm. The power source 92 creates a potential difference between the conductive polyimide substrate 21*b* and the application roller 13. The applied voltage in this embodiment is 200 V. The intermediate transfer belt 21 and the application roller 13 move with each other in the direction of the arrow D. The conductive setting agent 11 adheres to the application roller 13. As the application roller 13 rotates, the conductive setting agent 11 enters the region where the potential difference exists between the application roller 13 and the intermediate transfer belt 21. At this point, an electric charge is induced through the conductive application roller 13.

In this experiment, a negative charge was induced. The charged setting agent 11 was drawn toward the surface of the intermediate transfer belt 21, and was so transferred from the application roller 13 to the intermediate transfer belt 21. After that, an image was formed using the device shown in FIG. 6 (a recording unit such as the ink jet head 31), and the image formed on a recording sheet 42 was evaluated. The minute lines in characters were not broken, and each solid portion was uniform. Although the conductive rubber application roller 13 was used as the setting agent holding unit 90 in this experiment, an image as good as the image obtained with the conductive rubber application roller 13 was obtained with a conductive brush or a conductive blade used as the setting agent holding unit 90.

Where a conductive elastic body was used as the conductive setting agent holding unit 90, the nip width for applying the conductive setting agent 11 to the intermediate transfer belt 21 was reliably maintained.

Figure 10:
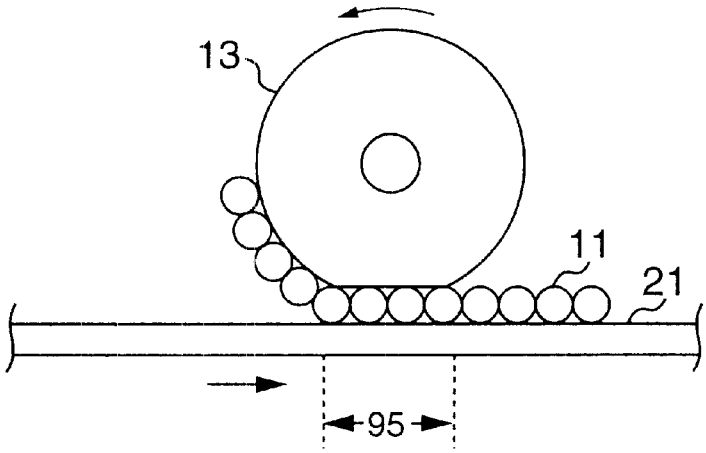
FIG. 10 shows a conductive elastic application roller brought into contact with the intermediate transfer belt of the embodiment shown in FIG. 9.

As shown in FIG. 10, when the conductive elastic application roller 13 is brought into contact with the intermediate transfer belt 21, a nip width 95 determined by the relationship between position and pressure is generated. The conductive setting agent 11 is charged in the electric field generated by the potential difference between the application roller 13 and the intermediate transfer belt 21. Therefore, the nip width 95 should be wide enough to induce an electric charge in the conductive setting agent 11, so that the conductive setting agent 11 securely adheres to the intermediate transfer belt 21. Where the setting agent holding unit 90 is not constituted by a conductive elastic body, the nip width is narrower, and the charge inducing time is accordingly shorter. Since the resistivity in the setting agent layer is not uniform, an electric charge is not sufficiently induced in areas having high resistivity, resulting in uneven application of the setting agent 11 to the intermediate transfer belt 21. To avoid such a situation, it is necessary to create a greater potential difference between the application roller 13 and the intermediate transfer belt 21. Examples of the preferred elastic application roller 13 include a urethane rubber roller, a silicone rubber roller, and a silicone sponge roller. With any of these rollers, the setting agent 11 could be applied uniformly to the intermediate transfer belt 21, and an excellent image was obtained.

Figure 11:
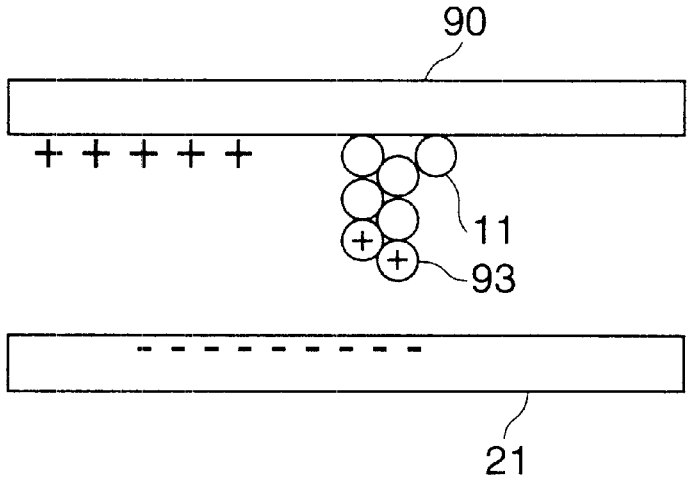
FIG. 11 illustrates a second principle of preferred application of a conductive setting agent onto the intermediate transfer belt.

FIG. 11 shows a second principle of preferred application of the conductive setting agent 11 to the intermediate transfer belt 21. First, the conductive setting holding unit 90 is charged in any suitable manner. Although the conductive setting holding unit 90 can be either positively or negatively charged, it is positively charged in FIG. 11. Meanwhile, the intermediate transfer belt 21 is charged with the polarity reverse to the polarity of the setting agent holding unit 90 in a suitable manner. In FIG. 11, the insulating intermediate transfer belt 21 is negatively charged. The conductive setting agent 11 held by the setting agent holding unit 90 obtains a positive charge 93 through the charge movement of the charged setting agent holding unit 90. The charged conductive setting agent 11 is then drawn toward the negative charge of the intermediate transfer belt 21, and is so transferred to the intermediate transfer belt 21. In this manner, the conductive setting agent 11 can be easily transferred and attached to the surface of the intermediate transfer belt 21, thereby eliminating the need to employ a power source for attaching the conductive setting agent 11 to the intermediate transfer belt 21.

Figure 12:
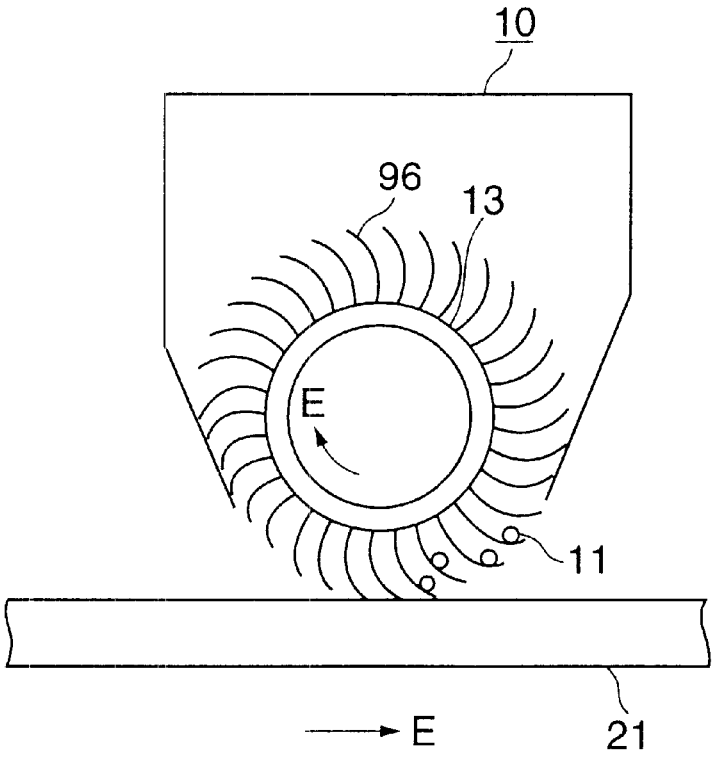
FIG. 12 shows an embodiment to which the second principle shown in FIG. 11 is applied.

FIG. 12 shows an embodiment to which the second principle shown in FIG. 11 is applied. This embodiment comprises the intermediate transfer belt 21, the application roller 13, and the setting agent applying unit 10. The intermediate transfer belt 21 is made of fluorine-containing resin. The application roller 13 comprises a stainless steel roller and a nylon brush 96 wrapped around the stainless steel roller. The application roller 13 and the intermediate transfer belt 21 move in the directions of arrows E. As the application roller 13 rotates, the nylon brush 96 wrapped around the application roller 13 scrapes the surface of the intermediate transfer belt 21. At this point, the surface of the intermediate transfer belt 21 is negatively charged, while the nylon brush 96 is positively charged. The conductive setting agent 11 adheres to the nylon brush 96, and the electric charge of the nylon brush 96 moves to the conductive setting agent 11. Thus, the conductive setting agent 11 is positively charged.

In an experiment carried out by the inventors, the positively charged conductive setting agent 11 was applied uniformly onto the negatively charged surface of the intermediate transfer belt 21. An image was then formed on the intermediate transfer belt 21 using the device shown in FIG. 6 (a recording device such as the ink jet head 31), and the image was transferred to a recording sheet. As a result, the obtained image had no broken minute lines in characters and had smooth solid portions.

Although the application roller 13 and the surface of the intermediate transfer belt 21 are charged at the same time in this embodiment, they may be separately charged by different charging devices.

The present invention is not limited to the specifically disclosed embodiments, but variations and modifications may be made without departing from the scope of the present invention.

The present invention is based on Japanese priority application Nos. 11-118796, filed on Apr. 26, 1999, 11-168914, filed on Jun. 15, 1999, and 2000-031253, filed on Feb. 8, 2000, the entire contents of which are hereby incorporated by reference.

What is claimed is:

1. A recording method comprising the steps of:

preparing a powdery material that is dissolved or swelled by liquid in advance and increases viscosity of the liquid, the powdery material being uniformly formed on a transfer medium;

forming an image on the transfer medium by bringing the liquid into contact with the powdery material; and transferring the image from the transfer medium to a recording medium.

2. The recording method according to claim 1, wherein the step of preparing the powdery material causes no friction.

3. A recording apparatus comprising:

a material preparing unit that prepares a powdery material that is dissolved or swelled by liquid in advance and increases viscosity of the liquid;

an image forming unit that forms an image on a transfer medium by bringing the liquid into contact with the powdery material; and a transfer unit that transfers the image from the transfer medium to a recording medium;

wherein the material preparing unit further comprises a material uniformly-applying unit that uniformly applies the powdery material to the transfer medium.

4. The recording apparatus according to claim 3, wherein the material uniformly-applying unit comprises a contact unit that is brought into contact with the powdery material formed on the transfer medium without causing friction.

5. The recording apparatus according to claim 4, wherein the contact unit has a surface that is smoother than the surface of the powdery material formed on the transfer medium.

6. The recording apparatus according to claim 4, wherein the surface of the contact unit has regular concavities and convexities.

7. The recording apparatus according to claim 4, further comprising a driving unit that moves the surface of the powdery material formed on the transfer medium and the surface of the contact unit at the same speed.

8. The recording apparatus according to claim 4, wherein the contact unit comprises a rotating unit that rotates in synchronization with the surface of the powdery material formed on the transfer medium.

9. The recording apparatus according to claim 4, wherein the contact unit further produces a powdery material that is dissolved or swelled by liquid and increases the viscosity of the liquid on the material already formed on the transfer medium.

10. A recording method comprising the steps of:

preparing a powdery material that is dissolved or swelled by liquid in advance and increases viscosity of the liquid on a transfer medium, the powdery material being a conductive powdery material;

forming an image on the transfer medium by bringing the liquid into contact with the conductive powdery material; and transferring the image from the transfer medium to a recording medium.

11. The recording method according to claim 10, wherein the conductive material is a sodium salt of poly(acrylic acid), a salt of poly(acrylic acid) and aliphatic amine, or the salts containing a conductive powder at a given weight ratio.

12. The recording method according to claim 10, wherein the step of preparing the conductive powdery material includes the steps of:

holding the conductive powdery material; and creating a potential difference between the conductive powdery material and the transfer medium when the conductive powdery material is transferred to the transfer medium.

13. The recording method according to claim 12, wherein the step of holding the conductive powdery material includes a step of injecting an electric charge into the conductive powdery material.

14. The recording method according to claim 13, wherein the step of creating the potential difference includes the step of electrifying the transfer medium.

15. A recording apparatus comprising:

a material preparing unit that prepares a powdery material that is dissolved or swelled by liquid in advance and increases viscosity of the liquid on a transfer medium, the material being a conductive powdery material;

an image forming unit that forms an image on the transfer medium by bringing the liquid into contact with the conductive powdery material;

a transfer unit that transfers the image from the transfer medium to a recording medium;

a conductive powdery material holding unit that holds the conductive powdery material;

an electrode unit that sandwiches the transfer medium with the conductive powdery material holding unit, and is situated opposite to the surface to which the conductive powdery material is transferred; and a potential difference creating unit that creates a potential difference between the conductive powdery material holding unit and the electrode unit.

16. The recording apparatus according to claim 15, wherein the conductive powdery material holding unit comprises an elastic member.

17. The recording apparatus according to claim 16, wherein the elastic member is a urethane rubber roller, a silicone rubber roller, or a silicone sponge roller.

18. A recording apparatus comprising:

a material preparing unit that prepares a powdery material that is dissolved or swelled by liquid in advance and increases viscosity of the liquid in a transfer medium, the material being a conductive powdery material;

an image forming unit that forms an image on the transfer medium by bringing the liquid into contact with the conductive powdery material;

a transfer unit that transfers the image from the transfer medium to a recording medium;

a conductive powdery material holding unit that holds the conductive powdery material;

a first charging unit that charges the conductive powdery material holding unit;

a second charging unit that charges a surface of the transfer medium; and a material affixing unit that affixes the conductive powdery material to the surface of the transfer medium by means of an electric charge injected into the conductive powdery material by the conductive material holding unit.

19. The recording apparatus according to claim 18, wherein the material affixing unit also serves as a transfer unit that transfers the conductive powdery material.

* * * * *